US011540655B2

(12) United States Patent
Krueger

(10) Patent No.: US 11,540,655 B2
(45) Date of Patent: Jan. 3, 2023

(54) ROLLING DRINK COASTERS

(71) Applicant: David Krueger, Cohasset, MA (US)

(72) Inventor: David Krueger, Cohasset, MA (US)

( * ) Notice: Subject to any disclaimer, the term of this patent is extended or adjusted under 35 U.S.C. 154(b) by 0 days.

(21) Appl. No.: 17/356,501

(22) Filed: Jun. 23, 2021

(65) Prior Publication Data

US 2022/0225808 A1 Jul. 21, 2022

Related U.S. Application Data

(63) Continuation of application No. 17/151,376, filed on Jan. 18, 2021, now Pat. No. 11,071,401.

(51) Int. Cl.
*A47G 23/03* (2006.01)

(52) U.S. Cl.
CPC ..... *A47G 23/0316* (2013.01)

(58) Field of Classification Search
CPC ..... A47G 23/0316
USPC ..... 248/346.11, 246.5, 211.2, 314, 129
See application file for complete search history.

(56) References Cited

U.S. PATENT DOCUMENTS 5,054,733 A * 10/1991 Shields ..... B60N 3/101 248/316.2
5,897,090 A * 4/1999 Smith ..... G01N 35/04 248/314
7,004,102 B2 2/2006 Sampson et al.
7,128,299 B1 10/2006 Klotz
8,662,580 B2 * 3/2014 Henke ..... B60N 3/101 297/188.14
9,775,455 B2 10/2017 Weissbart et al.
9,963,059 B2 * 5/2018 Cooper ..... B60N 3/106
2008/0011925 A1 1/2008 Ruff et al.
2013/0307393 A1 * 11/2013 Bridges ..... A47G 23/0306 248/346.11

FOREIGN PATENT DOCUMENTS

GB 517741 A * 8/1938

* cited by examiner

*Primary Examiner* — Kimberly T Wood
(74) *Attorney, Agent, or Firm* — Bold IP, PLLC; Honda El-Jarrah

(57) ABSTRACT

One or more embodiments for a rolling drink coaster. The rolling drink coaster includes a top assembly coupled to a bottom plate. A plurality of rollers are disposed on an underside of the rolling drink coaster that allow the drink coaster to roll and to be movable over a surface. An interior cavity of the rolling drink coaster is configured to hold a beverage container. The rolling drink coaster includes one or more stabilizer pieces configured to support and stabilize the beverage container when located inside of the rolling drink coaster. The rolling drink coaster may have an angled top body or a straight cylindrical shaped top body. In one embodiment, a bottom plate is fastened to a bottom surface of the top assembly of the rolling drink coaster. The bottom plate is configured to receive one or more axel assemblies that surround each roller and allow the drink coaster to move.

15 Claims, 14 Drawing Sheets

ROLLING DRINK COASTERS

CROSS-REFERENCE TO RELATED APPLICATIONS

This application is a continuation application that claims priority to U.S. Non-Provisional patent application Ser. No. 17/151,376 filed on Jan. 18, 2021, which is incorporated by reference in its entirety.

FIELD OF THE DISCLOSURE

The present invention relates to various embodiments for a rolling drink coaster configured to hold one's drink safely and securely in a movable drink coaster.

BACKGROUND

Many individuals enjoy using drink coasters to protect their table surfaces and to hold their drinks. Most drink coasters are flat or cylindrical shaped. Most drink coasters are also are stationary and not mobile. Some drink coasters have been created that have one or more wheels or rollers, but they do not have a stable and secure a structure as would be desirable to prevent the beverage container held inside from falling out.

It would be desirable to have a drink coaster that is movable and can roll on a table surface but can also accommodate drinks of varying sizes in a snug and tight manner. Further, it would be desirable to have a drink coaster that is movable but includes a means to stabilize a beverage container located within the rolling drink coaster.

SUMMARY

One or more embodiments are provided for a rolling drink coaster. The rolling drink coaster may include a top assembly which includes a top insert piece coupled to a top body piece. The rolling drink coaster may further include one or more stabilizers distributed around an inner perimeter of the top assembly. Further, the rolling drink coaster may include a bottom plate, whereby the bottom plate is coupled to a bottom surface of the top assembly. The rolling drink coaster may further include one or more rollers that extend through a body of the bottom plate. The rolling drink coaster may be mobile due to the presence of the one or more rollers.

Another embodiment for a rolling drink coaster, as described herein, may include an outer body having one continuous outer wall and an interior cavity. The rolling drink coaster may further include an insert piece, whereby the insert piece is coupled to an inner wall of the outer body and extends around an inner perimeter of the outer wall of the outer body. The rolling drink coaster may further include one or more stabilizers connected to an interior wall of the insert piece, as well as a base. The base may be coupled to a bottom surface of the outer body. The rolling drink coaster may include one or more rollers, whereby the one or more rollers protrude from a bottom surface of the base and allow the rolling drink coaster to be mobile. The insert piece may be made of foam in order to provide additional cushioning and stability for holding a beverage container.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
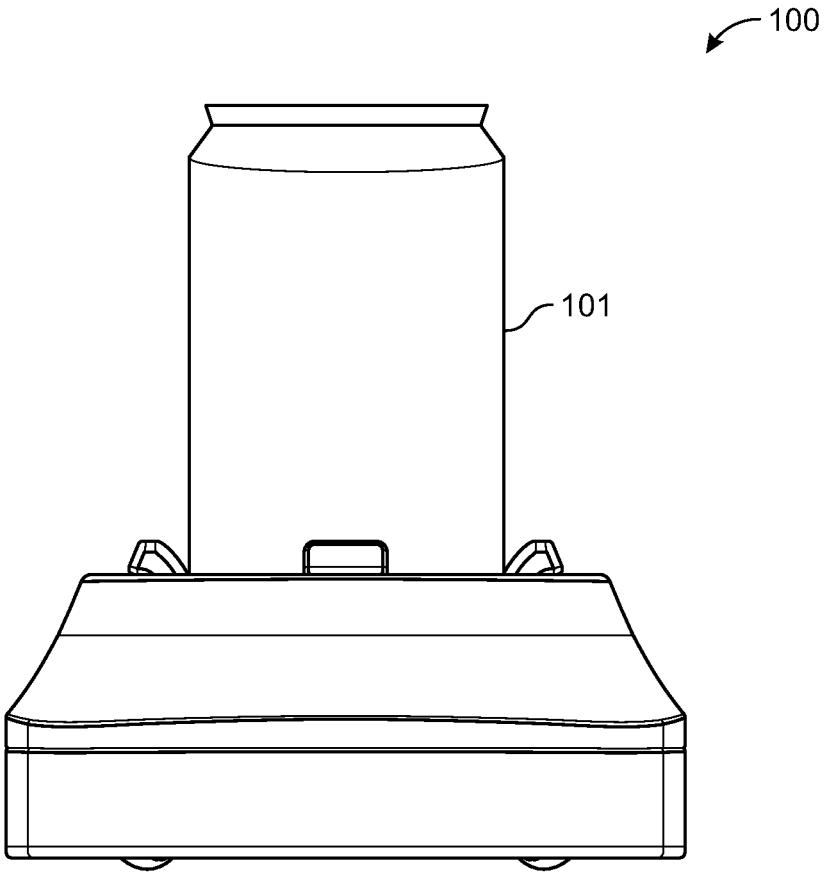
FIG. 1 is a pictorial illustration of a rolling drink coaster with a beverage container located inside of the rolling drink coaster according to one non-limiting embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally drawn to various embodiments for a rolling drink coaster. Advantageously, the rolling drink coasters as described herein are capable of securely storing and holding a beverage container in an upright position and are also mobile due to the inclusion of one or more rollers or wheels that protrude from the underside of the rolling drink coasters. The structure and design of the rolling drink coasters, as described in one or more non-limiting embodiments, is unique because the rolling drink coaster is designed in a manner to be sturdy and to prevent the beverage container from toppling over when located within the inner compartment or tray of the rolling drink coaster. Further, the rolling drink coasters, as described in one or more non-limiting embodiments, include stabilizing pieces distributed around the interior of the rolling drink coaster that act to support and grip the sides of the beverage container to keep the beverage container upright and in place within the rolling drink coaster. Further details will be provided with respect to the accompanying Figures.

FIG. 1 is a pictorial illustration of a first non-limiting embodiment for a rolling drink coaster 100. Rolling drink coaster 100 is shown in FIG. 1 with an example beverage container 101 positioned within an inner cavity of the rolling drink coaster 100. Beverage container 101 is shown as being a can, but any type of beverage container 101 may be used and positioned within an inner cavity of the rolling drink coaster 100. The rolling drink coaster 100 may be made having various sizes and diameters to accommodate a variety of beverages and beverage containers. Beverage container 101 may hold any type of beverage desired by the user, including, but not limited to alcohol, sodas, juice, water, coffee, tea, sports drinks, or any other type of beverage.

Figure 2:
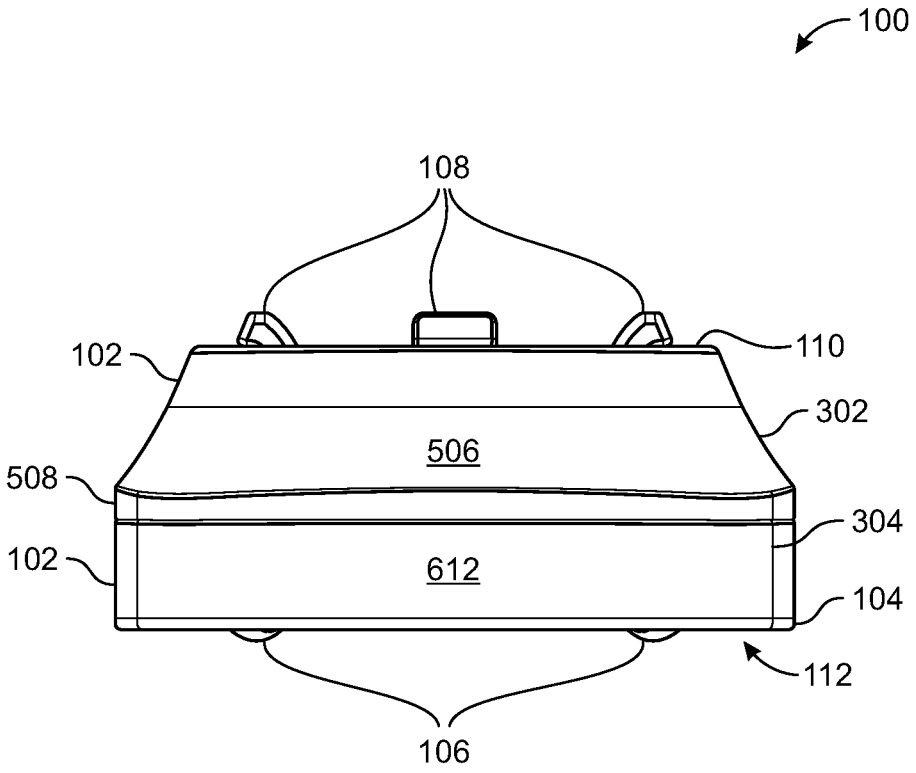
FIG. 2 is a pictorial illustration of the rolling drink coaster shown in FIG. 1.
Figure 5A:
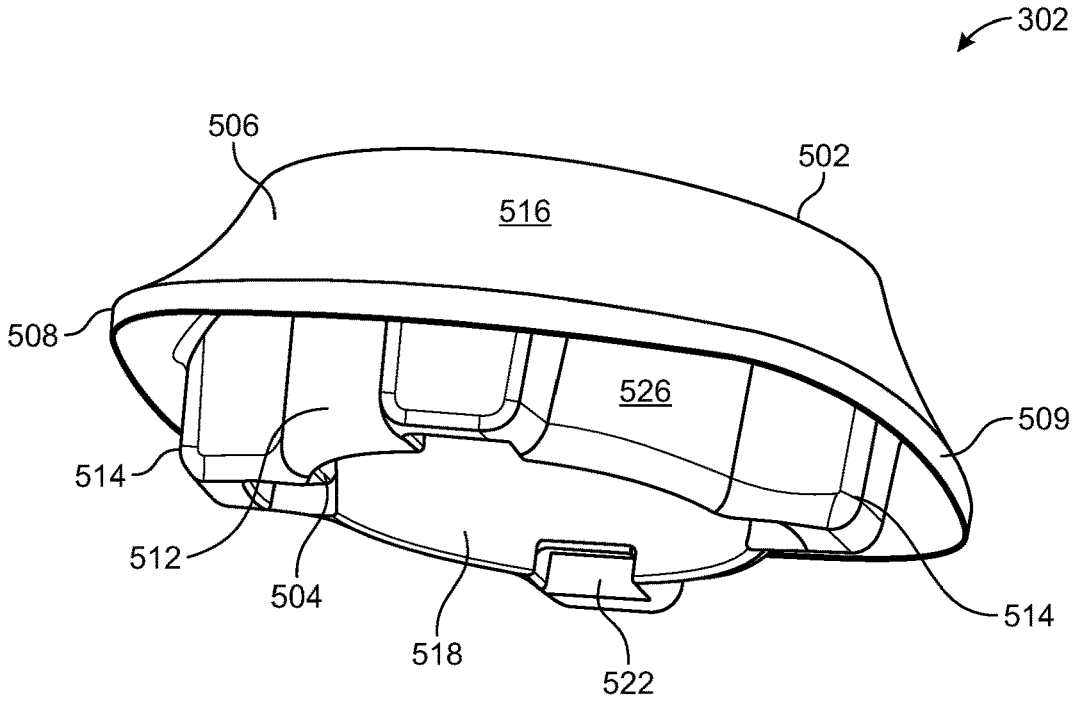
FIG. 5A is a side perspective view of a top insert piece for a rolling drink coaster.
Figure 7A:
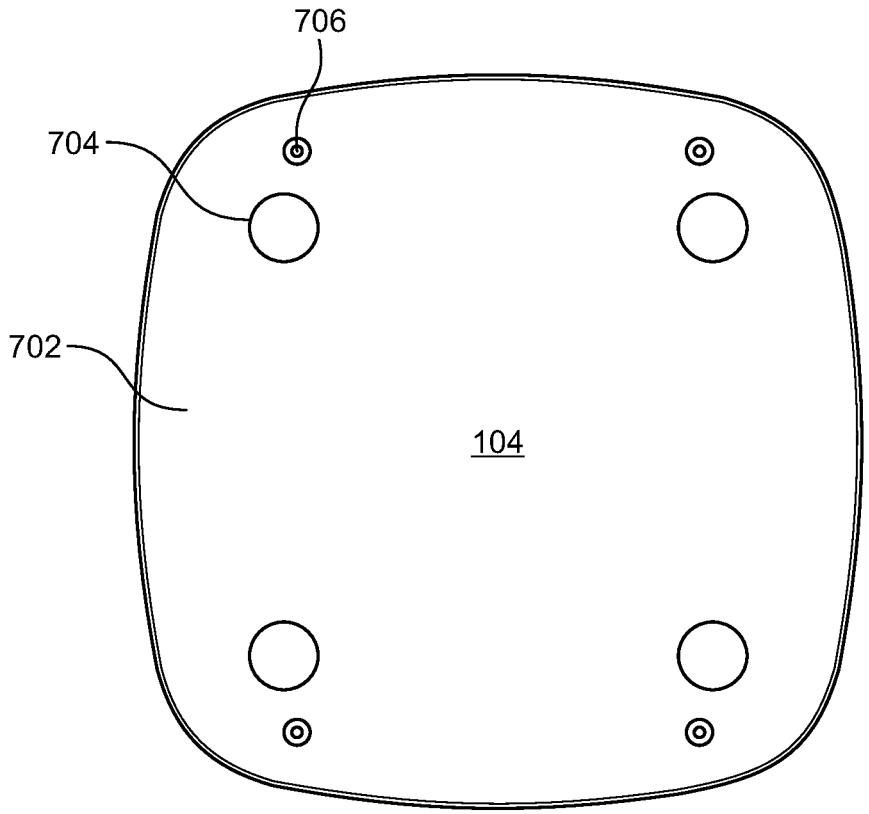
FIG. 7A is a bottom view of the bottom plate of the rolling drink coaster shown in FIG. 1.

FIG. 2 shows rolling drink coaster 100 without a beverage container 101. In FIG. 2, the rolling drink coaster 100 is shown including one or more stabilizers 108, a top assembly 102, a bottom plate 104, and a one or more rollers 106. The one or more rollers 106 are positioned on a bottom surface 112 of the rolling drink coaster 100, which is the same as the bottom surface 702 (e.g., as shown in FIG. 7A) of the bottom plate 104. The one or more stabilizers 108 are shown as protruding above the top surface 110 of the rolling drink coaster 100, which is the same as the top surface 502 (e.g., as shown in FIG. 5A) of the top insert piece 302 of the top assembly 102.

As further discussed below with respect to FIGS. 5A-6D, the top assembly 102 includes a top insert piece 302 coupled to a top body piece 304, in which the top insert piece 302 covers the top body piece 304. When the top insert piece 302 covers the top body piece 304, the outer wall 506 of the top insert piece 302 is visible as is the lip 508 of the top insert piece 302 from an outside view of the rolling drink coaster 100, as is the base 612 of the top body piece 304 in one or more non-limiting embodiments. Further details for the top assembly 102 and its components are described below with respect to FIGS. 5A-6D.

Figure 3:
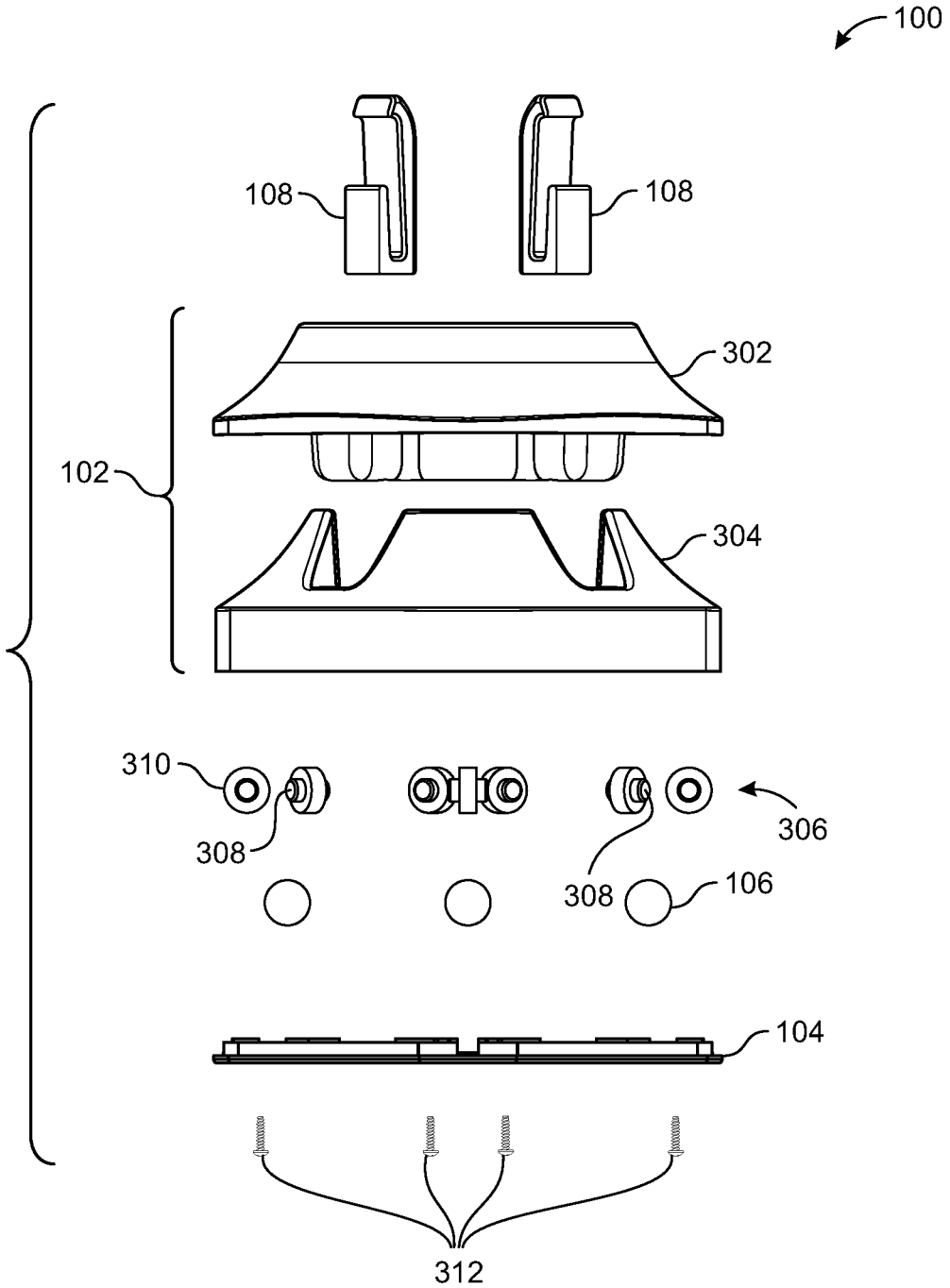
FIG. 3 is an exploded view of the rolling drink coaster shown in FIG. 1.

FIG. 3 is an exploded view of the one or more components that may be included in the rolling drink coaster 100 shown in FIG. 1. In a non-limiting embodiment, the rolling drink coaster 100 may include, in a non-limiting embodiment, a plurality of stabilizers 108, a top assembly 102, a plurality of axel assemblies 306, a bottom plate 104, and one or more rollers 106.

As further explained below in FIGS. 5A-6D, the top assembly 102 may comprise or include a top insert piece 302 that connects and fits within a designated area of the top body piece 304 shown in FIG. 3. The axel assemblies 306 may comprise a pin 308 located within an internal bore of the holding ring 310 located around each pin 308. Further, the bottom plate 104, as shown in FIG. 3, may be fastened to the underside of the top body piece 304 of the top assembly 102 via one or more fasteners 312.

Figure 4A:
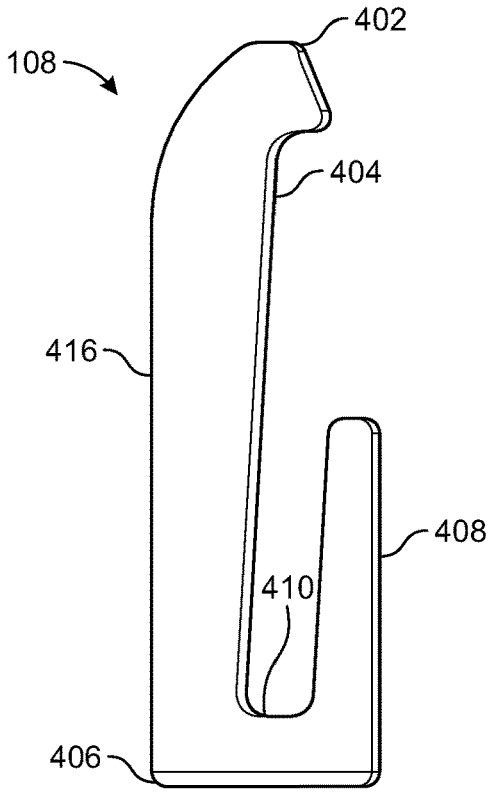
FIG. 4A. is a side view of a stabilizer used in the rolling drink coaster.
Figure 4B:
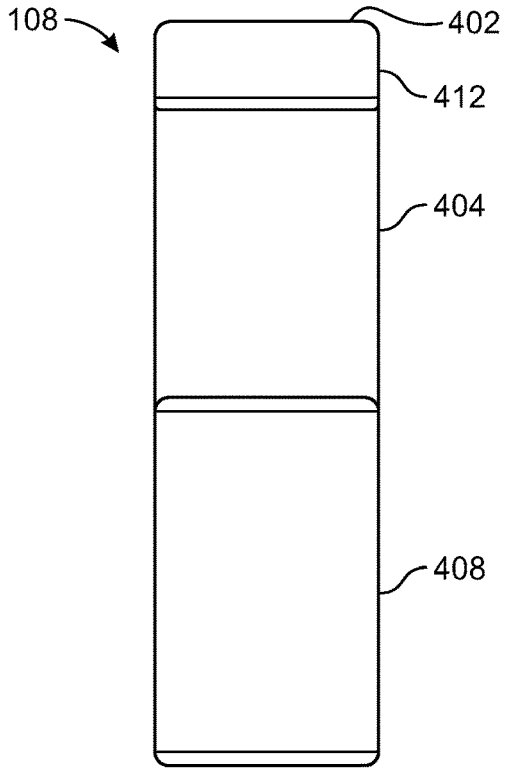
FIG. 4B is a front view of the stabilizer shown in FIG. 4A.
Figure 4C:
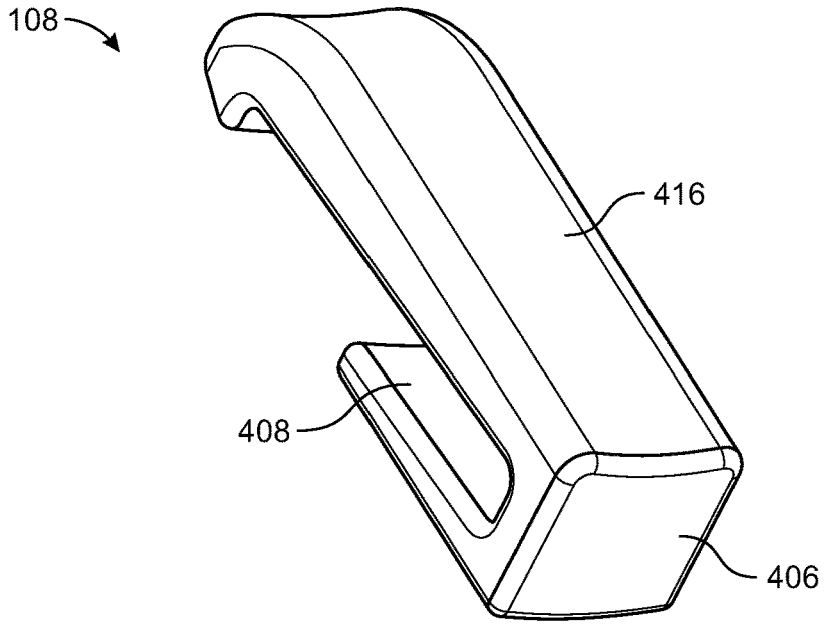
FIG. 4C is a rear perspective view of the stabilizer shown in FIG. 4A.

FIGS. 4A-4C show a variety of views of the one or more stabilizers 108 that are a component of the rolling drink coaster 100. FIG. 4A shows a side view of stabilizer 108, while FIG. 4B shows a front view, and FIG. 4C shows a rear perspective view of the stabilizer 108.

As mentioned previously, the stabilizer 108 functions to support and brace the beverage container 101 within the inner cavity of the rolling drink coaster 100. Further, the stabilizers 108 may act as a cushion to cushion the beverage container 101 braced against each stabilizer 108. In a preferred, but non-limiting embodiment, there may be at least four stabilizers 108 (e.g., as shown in FIG. 5D and FIG. 5E) located at approximately right angles from each other and distributed around the inner perimeter of the rolling drink assembly 100. Accordingly, the beverage container 101 is securely held in place by the body of the stabilizers 108, and it is less likely that the beverage container 101 (e.g., as shown in FIG. 1) will fall or topple to one side within the rolling drink coaster 100 or outside of the rolling drink coaster 100. Further, the stabilizers 108 may help to snugly secure beverage containers 101 with a slimmer profile and much smaller diameter than the diameter of the inner cavity of the rolling drink coaster 101. It is anticipated that the rolling drink coaster 100 may hold a variety of sizes of beverage containers 101 including those that have a wider diameter and shorter height profile as well as those beverage containers 101 that have a narrower diameter and taller height profile.

The stabilizer 108 may be made of any type of material, including, but not limited to plastic, foam, rubber, silicone, or a combination thereof. It may be preferable for the stabilizers 108 to be made of a material having a good amount of flexibility and compressibility so that the sides of the beverage container 101 can push against the one or more stabilizers 108 when located within the inner cavity of the rolling drink coaster 100 and the one or more stabilizers 108 can deflect slightly. When the beverage container 101 is removed for the user to drink from the beverage container 101, it should be easy for the user to remove or pull out the beverage container 101 and also should not be difficult for the user to fit the beverage container 101 within the inner cavity of the rolling drink coaster 100. If the material of the one or more stabilizers 108 has some degree of flexibility and compressibility, such as if the material is made of foam, rubber, silicone, or any other material with the same flexibility, it may be easy for the user to position the beverage container 101 in the rolling drink coaster 100.

In a non-limiting embodiment, each stabilizer 108 may include a top portion 402, a vertical piece 404, and a bottom piece 406. The vertical piece 404 of the stabilizer 108 may connect the top portion 402 of the stabilizer 108 to the bottom piece 406. Each stabilizer 108 may further include a hook piece 408 as shown in FIGS. 4A-4C. The hook piece 408 may be relatively straight in one or more non-limiting embodiments, as is the vertical piece 404 which includes a straight appearance as shown in FIGS. 4A-4C. The top portion 402 of the stabilizer 108 may be angled or curved 412 as shown in FIG. 4B. There may be an internal gap 410 between an inner side of the vertical piece 404 and the inner side of the hook piece 408. The back 416 of the stabilizer 108 may have a rounded or curved appearance in one or more non-limiting embodiments. As shown in FIG. 4A and FIG. 4C, the back 416 of the stabilizer 108 is rounded or curved towards the top of the back 416 and as it approaches the top portion 402 of the stabilizer 108. As shown in FIG. 1 and FIG. 2, in a non-limiting embodiment, the top portion 402 of each stabilizer 108 may protrude above the top 110 of the top assembly 102 so that the top portion 402 of each stabilizer 108 is visible from the top of the rolling drink coaster 100. Further, the top portion 402 of each stabilizer 108 is curved towards the top edges of the top assembly 102 as shown in FIGS. 1-2.

As further explained below, and shown in FIGS. 5A-6D, the top assembly 102 includes a top insert piece 302 and a top body piece 304 that have dedicated slots and spaces to receive the one or more stabilizers 108. Notably, the hook piece 408 of each stabilizer 108 is designed to hook onto a dedicated slot of the top assembly 102, and in particular, to a dedicated slot (e.g., hook receiving slot 522 as shown in FIG. 5A and FIG. 5C) of the top insert piece 302 as further explained below.

Figure 5B:
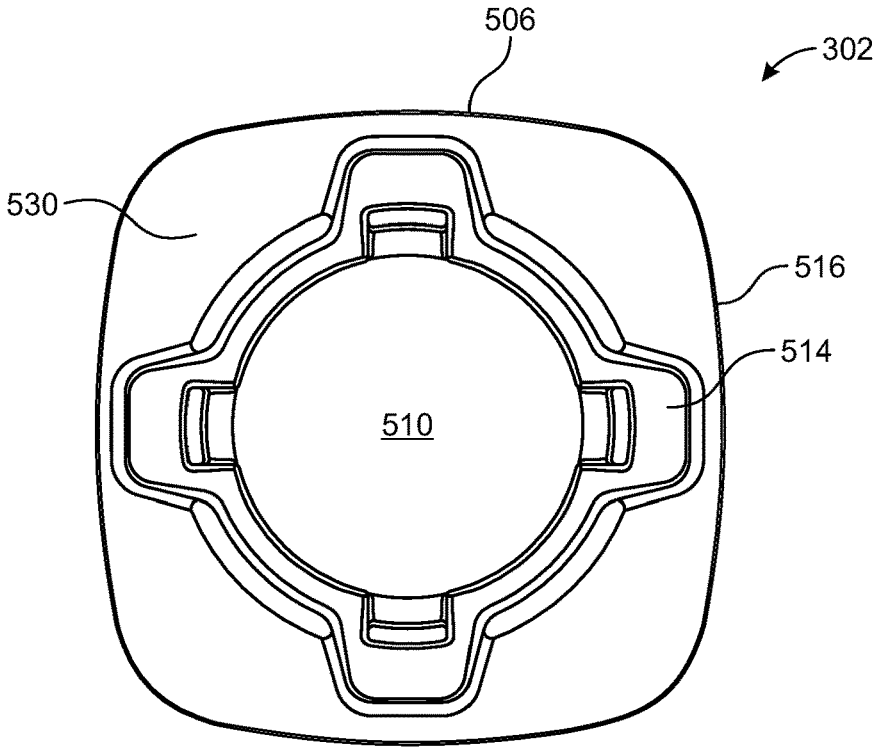
FIG. 5B is a bottom view of the top insert piece shown in FIG. 5A.
Figure 5C:
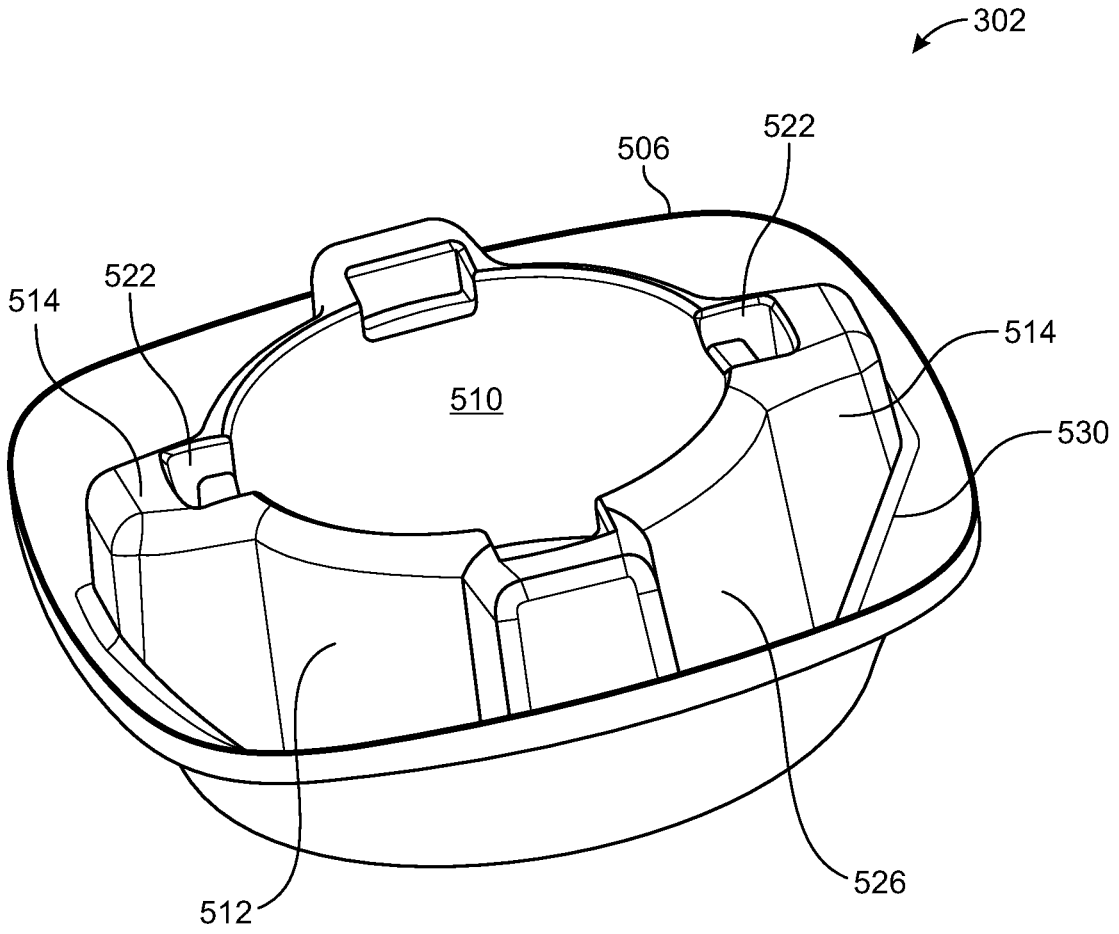
FIG. 5C is a bottom perspective view of the top insert piece shown in FIG. 5A.
Figure 5D:
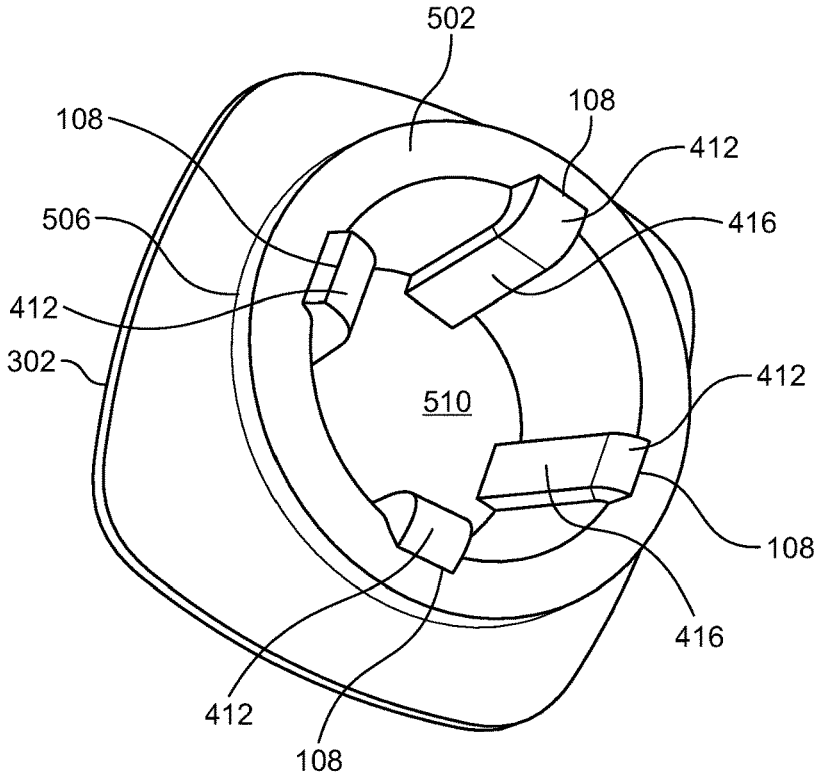
FIG. 5D is a top view of the top insert piece shown in FIG. 5A with the stabilizers shown in FIG. 4A located within the top insert piece.
Figure 5E:
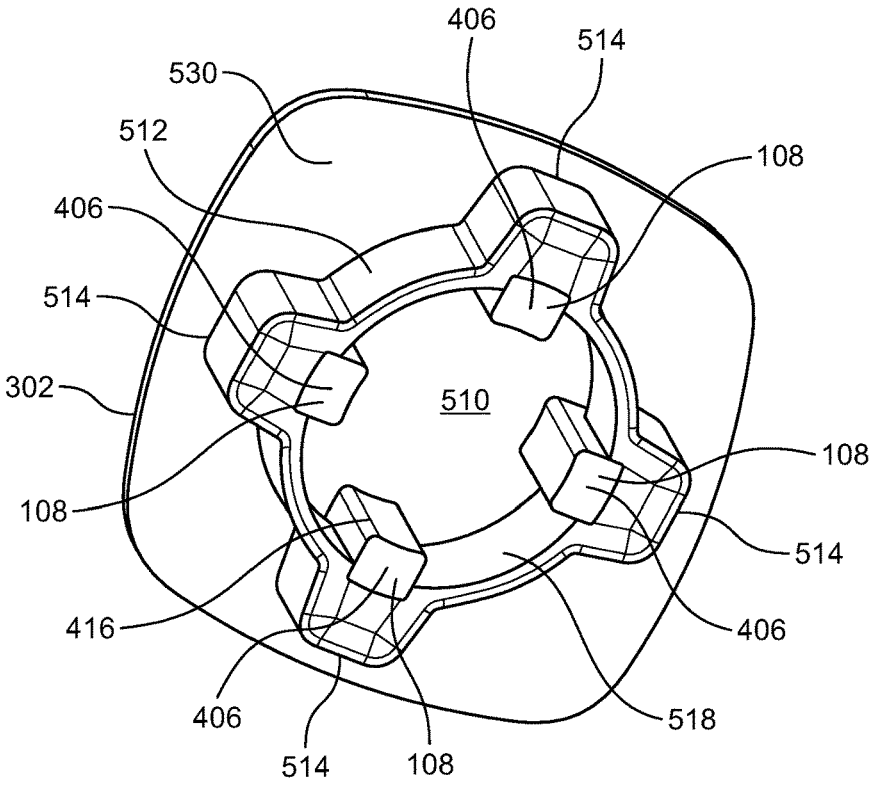
FIG. 5E is a bottom view of the top insert piece with the stabilizers shown in FIG. 4A located within the top insert piece.

Turning to FIGS. 5A-5C, FIGS. 5A-5C show various views of the top insert piece 302 which is a part of the top assembly 102 of the rolling drink coaster 100 in one or more non-limiting embodiments. FIG. 5A is a side perspective view of a top insert piece 302. FIG. 5B is a bottom view of the top insert piece 302 and FIG. 5C is a bottom perspective view of the top insert piece 302.

As shown in FIGS. 5A-5C, the top insert piece 302 may include an upper outer wall 506 and a lower inner wall 512 that extends beneath the outer wall 506 of the top insert piece 302. The upper outer wall 506 is above the lower inner wall 512, in one non-limiting embodiment, and the lower inner wall 512 may be recessed from the lip 508 or edges of the outer wall 506. Accordingly, in one non-limiting embodiment, as shown in FIG. 5A-5E, the lip 508 of the outer wall 506 may extend beyond the perimeter of the inner wall 512. The sides 516 of the outer wall 506 may be angled in one or more non-limiting embodiments. The lip 508 may have a straight profile in comparison to the angled sides 516 of the outer wall 506 in one or more non-limiting embodiments.

The top insert piece 302 may have a rounded top surface 502 as shown in FIG. 5A. The top insert piece 302 may further include an internal bore 510 as shown in FIG. 5B that extends completely through the body of the top insert piece 302. The lower inner wall 512 may define the internal bore 510. Accordingly, the inner walls 518, as shown in FIG. 5A and FIG. 5E, of the lower inner wall 512 may encircle the internal bore 510 in one or more non-limiting embodiments as shown. There may also be a gap or space 530 as shown in FIG. 5B, FIG. 5C, and in FIG. 5E on the underside of the top insert piece 302 that separates the outer wall 506 from the outer sides of the inner wall 512. It is noted that the beverage container 101 shown in FIG. 1 is intended to fit within the internal bore 510 of the top insert piece 302 as braced against one or more stabilizers 108 (e.g., as shown in FIG. 1).

The stabilizers 108 are configured to fit within dedicated stabilizer slots 514 that are integrated into the body of the top insert piece 302. The stabilizer slots 514 project from the outer sides 526 of the inner wall 514 and include dedicated hook piece slots 522 for receiving or accepting the hook pieces 408, as shown in FIGS. 4A-4C, of the stabilizers 108.

As shown in FIGS. 5A-5C, the hook pieces 408 of each stabilizer 108 has a corresponding dedicated hook piece slot 522 as shown in FIGS. 5A-5E for inserting each hook piece 408 of each stabilizer 108 for the rolling drink coaster 100. As shown in FIGS. 5A-5E, in one or more non-limiting embodiment, there may be four stabilizer slots 514 distributed around the inner wall 512 of the top insert piece 302 and spaced apart from each other. In one non-limiting embodiment, each of the four stabilizer slots 514 may be positioned generally centrally on each side of the inner wall 512 and positioned generally perpendicular to the adjacent stabilizer slot 514.

FIGS. 5D-5E show the stabilizers 108 that have been inserted into their designated slots 514 on the top insert piece 302. FIG. 5D shows a top view of the stabilizers 108 inserted and coupled to the top insert piece 302 of the top assembly 102 while FIG. 5E shows a bottom view of the stabilizers 108 as coupled to the top insert piece 302.

As shown in FIGS. 5D-5E, the manufacturer or other party can position the stabilizer 108 so that the top 402 of each stabilizer 108 is visible from a top view of the top insert piece 302. The top 402 of each stabilizer 108 may be oriented facing towards an inner wall of the outer wall 506 such that the angled top piece 412 of each stabilizer 108 sits over the top side of an inner wall of the outer wall 506 and the straight vertical piece 404 of each stabilizer (e.g., as shown in FIGS. 4A-4C) for each stabilizer 108 contacts a corresponding inner wall of the outer wall 506 of the top insert piece 302. Further, the bottom piece 406 of each stabilizer 108 is visible from an underside of the top insert piece 302 when inserted in position, as shown in FIG. 5E. The hook piece 408 of each stabilizer 108 is not visible (e.g., as shown in FIG. 5E) from the underside of the top insert piece 302 when the hook piece 408 has been pushed up into a corresponding dedicated hook piece slot 522 for the corresponding stabilizer slot 514 on the top insert piece 302. Rather, the hook piece 408 is pushed up into the hook piece slot 522 and only the bottom piece 406 of each stabilizer 108 may be visible from a bottom perspective view when the stabilizers 108 are coupled to the top insert piece 302. As shown in FIGS. 5A-5E, the internal bore 510 of the top insert piece 302 is still visible and configured to receive a beverage container 101 with the stabilizers 108 in position.

Figure 6A:
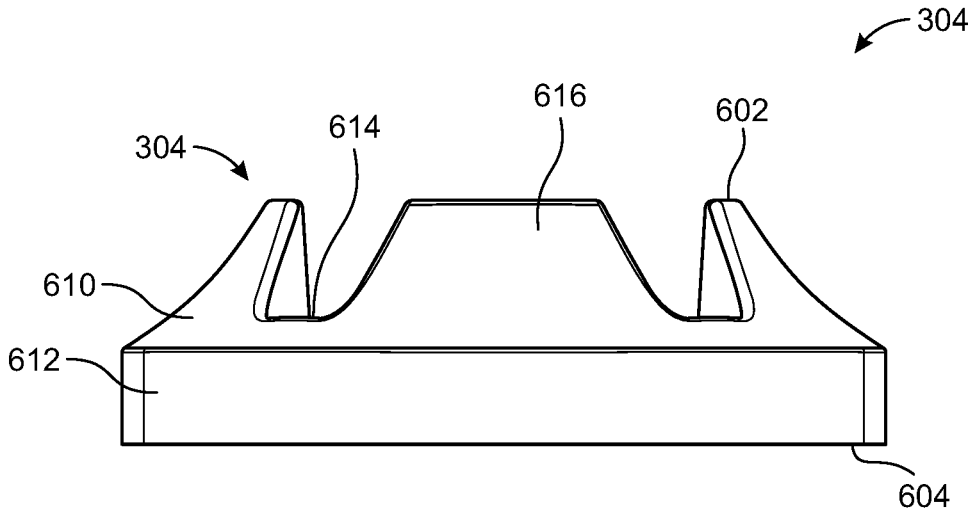
FIG. 6A is side view of a top body piece for a rolling drink coaster.
Figure 6B:
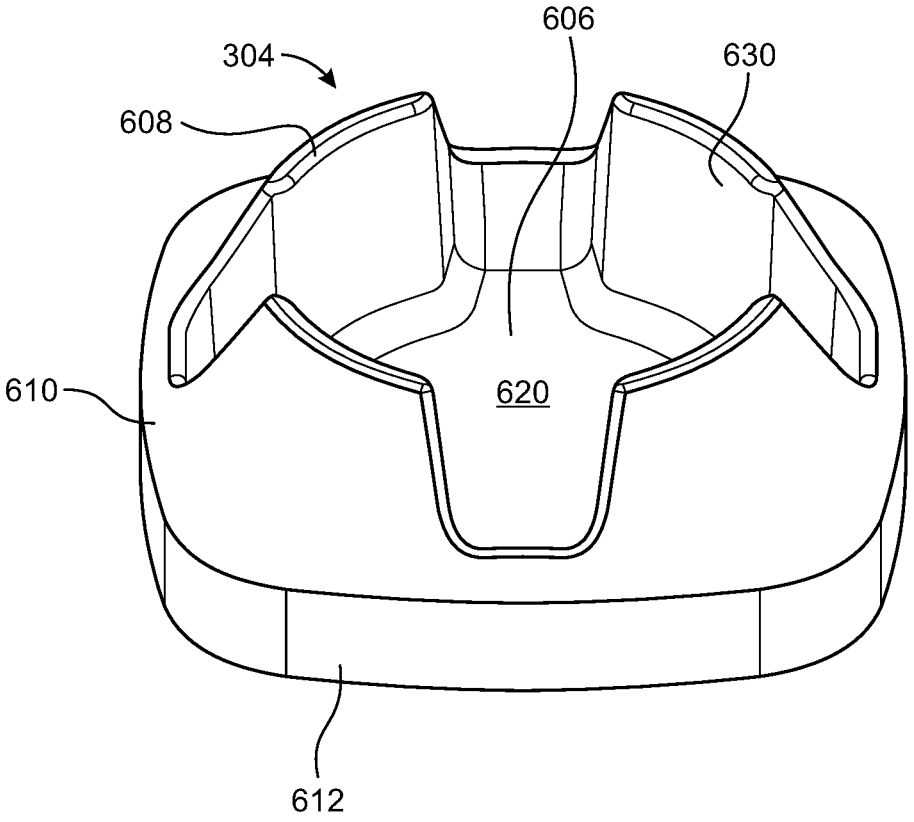
FIG. 6B is a top perspective view of the top body piece shown in FIG. 6A.

Turning to FIGS. 6A-6D, FIGS. 6A-6D show the top body piece 304, which is the second component of the top assembly 102 for the rolling drink coaster 100. As shown in FIG. 3, the top insert piece 302 is configured to couple to the top body piece 304 to form the top assembly 102. More specifically, the top insert piece 302 is configured to fit within the designated interior tray or cavity 606, as shown in FIG. 6B, of the top body piece 304 and to abut onto the bottom tray 620 of the top body piece 304. The top body piece 304 is configured to fit the contours and profile of the top insert piece 302 in order to fit the top insert piece 302 over the top body piece 304.

As shown in FIGS. 6A-6B, the top body piece 304 includes a top outer wall 610 that merges with a base 612. The outer wall 610 may include angled components 616 as shown in FIG. 6A, that have gaps or notches 614 placed in between each angled component 616. The top surface 602 of each angled component 616 may include a top edge 608 that angles towards the interior cavity 606 of the top body piece 304. A bottom surface 604 of the top body piece 304 may include dedicated spaces for receiving one or more axel assemblies 306 (e.g., as shown in FIG. 3 and FIG. 6D).

FIG. 2 shows the top insert piece 302 is covering the top body piece 304 to form the top assembly 102. Accordingly, when fitted together, the top insert piece 302 covers the top body piece 304 and couples together. The top insert piece 302 is configured to slide over and on top of the body piece 304 and to fit by press fitting the two together. However, in some non-limiting embodiments, adhesives, fasteners, or other means of attaching the top insert piece 302 to the top body piece 304 may also be used.

In order to fit the top insert piece 302 over the top body piece 304, the internal bore 606 of the top body piece 304 may be sized to be wide enough to receive the inner wall 512 of the top insert piece 302 with the stabilizers 108 inserted into the dedicated stabilizer slots 514 and hook piece slots 522 on the inner wall 512 of the top insert piece 302. The internal bore 606 may contain the inner wall 512 of the top insert piece 302 while the outer wall 506 of the top insert piece 302 may extend over and cover the top outer wall 610 of the top body piece 304. As shown in FIG. 2, the outer wall 506 of the top insert piece 302 is visible from an outside view of the rolling drink coaster 100, but the inner wall 512 of the top insert piece 302 is not visible from an outside view of the rolling drink coaster 100, because the inner wall 512 of the top insert piece 302 is located within the internal bore 606 of the top body 304. As also shown in FIG. 2, the base 612 of the top body piece 304 is also visible from an outside view of the rolling drink coaster 100, but the top outer wall 610 of the top body piece 304 is not, because the outer wall 610 of the top body piece 304 is covered by the outer wall 506 of the top insert piece 302.

To further clarify the coupling together of the top insert piece 302 to the top body piece 304, each gap 614 on the top body piece 304 is configured to receive a stabilizer slot 514. Further, the inner wall 630, as shown in FIG. 6B, of each angled piece 616 of the top body 304 contacts an exterior wall 526 (e.g., as shown in FIG. 5A and FIG. 5C) of the inner wall 512.

Figure 6C:
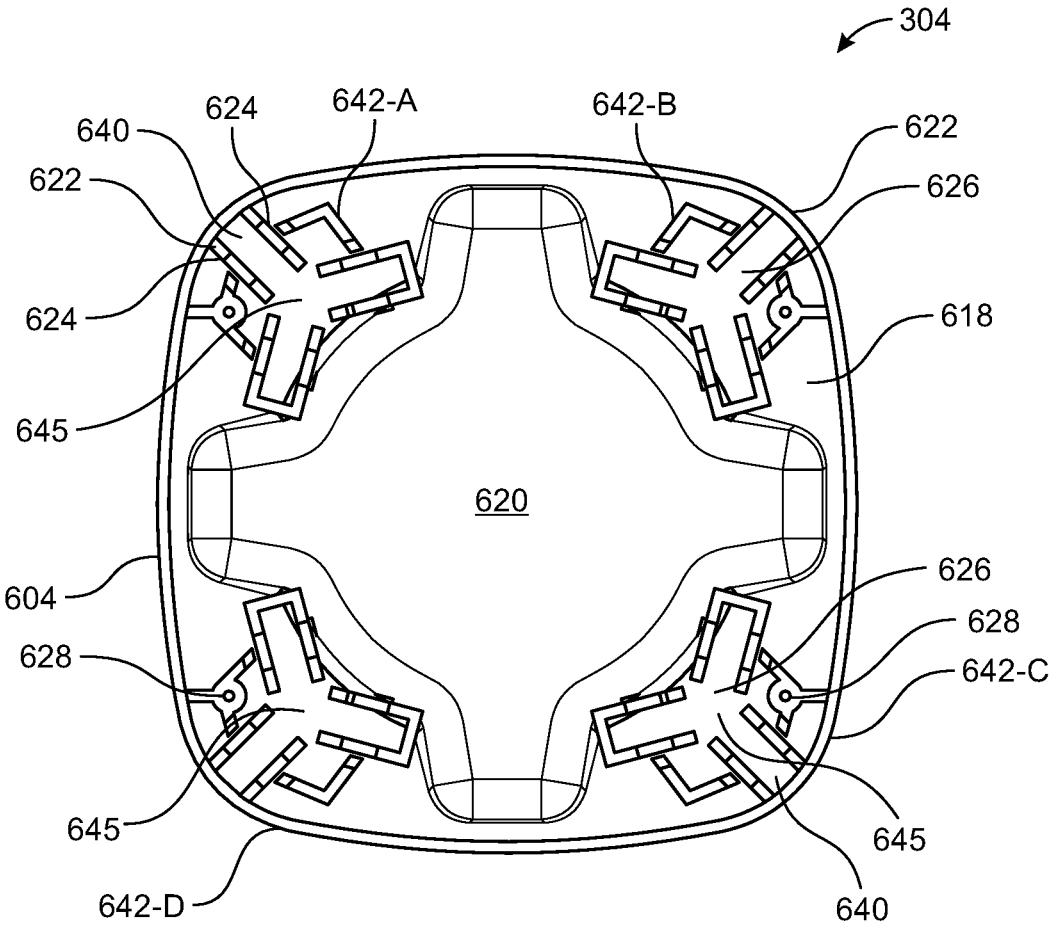
FIG. 6C is a bottom view of the top body piece shown in FIG. 6A.
Figure 6D:
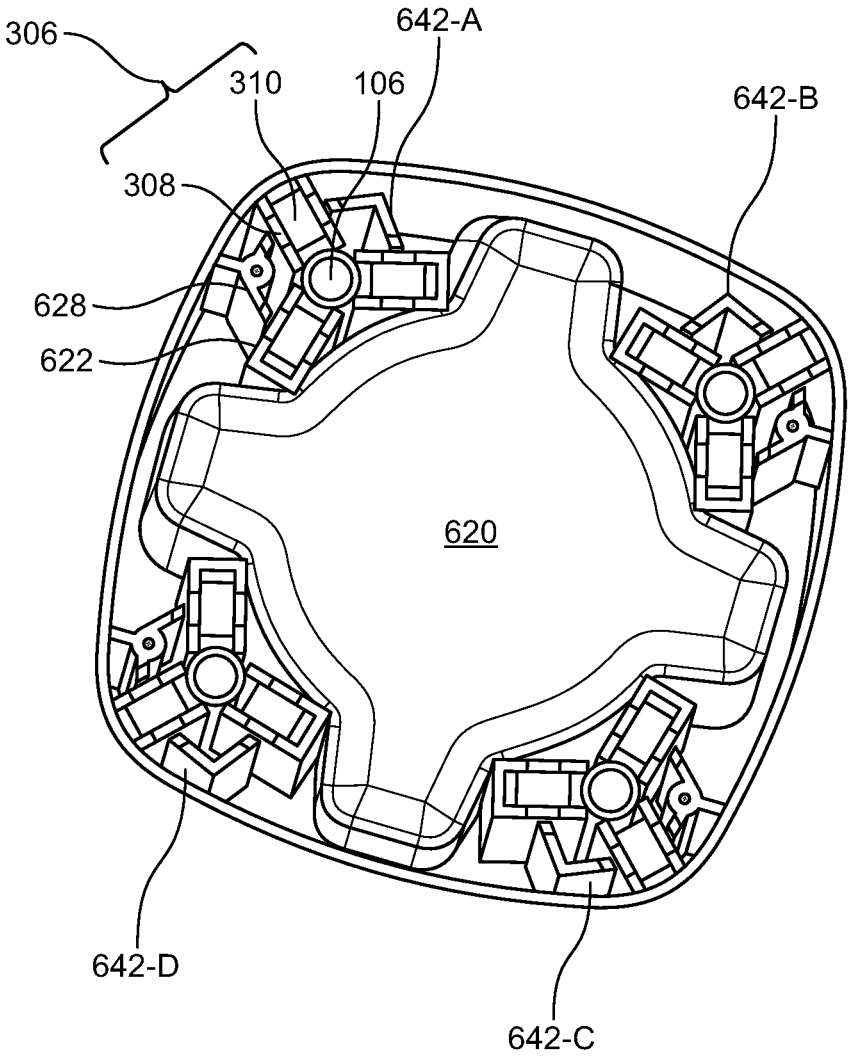
FIG. 6D is a bottom view of the combination of the axel assembly and rollers positioned on the bottom surface of the top body piece.

FIG. 6C may show a bottom view of the top body piece 304, and in particular the bottom surface 604 of the top body piece 304. The bottom surface 604 of the top body piece 304 includes the closed bottom tray 620, as shown in FIGS. 6B-6D. Accordingly, the bore 606 of the top body piece 304 is terminated by the closed bottom tray 620 that extends along a bottom surface 604 of the top body piece 304.

In addition to connecting to the top insert piece 302, the top body piece 304 may also function to hold one or more axel assemblies, such as axel assembly 306 as shown in FIG. 3 and discussed briefly above. In a non-limiting embodiment, each axel assembly 306 may include an elongated pin 308 and a disc like holding ring 310. The pin 308 is configured to be inserted into the bore of the holding ring 310. The bottom 604 surface of the top body piece 304 includes a grouping 642 of designated slots 622 for each axel assembly 306. As shown in FIG. 6C, there may be four groupings 642, in a non-limiting embodiment, of designated slots 622 for each axel assembly 306, including grouping 642-A, 642-B, 642-C, and 642-D. Each axel assembly slot 622 may include the pair of walls 624 that are parallel or opposite each other with a gap 640 in between each wall 624. Each grouping 642 is able to hold at least three axel assemblies 306 that are distributed in a generally triangular arrangement in the corresponding, dedicated axel assembly slots 622, because the axel assembly slots 622 are also distributed in a generally triangular arrangement as shown in FIG. 6C. In the center 645 of each grouping 642, there may be a dedicated roller space 626 in the center 645 for receiving a roller, such as roller 106.

FIG. 6D shows an exemplary embodiment of each axel assembly 306 positioned within the designated axel assembly slots 622 for each grouping 642-A, 642-B, 642-C, and 642-D on an underside of the top body piece 304. Accordingly, as shown in FIG. 6D, grouping 642-A, for example, has a pin 308 that has been inserted into the bore of the holding ring 310 and inserted in between each wall 624 (e.g., as shown in FIG. 6C) in the receiving axel assembly slot 622. It is noted that the holding ring 310 is positioned perpendicularly over the elongated pin 308. In the center 645 of the grouping 642-A, and for each grouping 642-B, 642-C, and 642-D, is located a roller 106 as shown in FIG. 6D. Accordingly, FIG. 6D shows one non-limiting embodiment for how the rollers 106 may be positioned on an underside of a top body piece 304 in order to allow the rolling drink coaster 100 to be mobile. As shown in FIG. 6D, in one or more non-limiting embodiments, there may be four groupings 642 of axel assemblies 306 and at least four rollers 106 provided on an underside 604 of the top body piece 304 of the rolling drink coaster 100. Each roller 106 is generally located in one corner area on an underside of the top body piece 304 although in alternative embodiments, the rollers 106 may be distributed in a different arrangement.

The bottom side 604 of the top body piece 304 may further include one or more fastener holes 628 for receiving one or more fasteners 312, which are shown in FIG. 3. Each fastener 312 is configured to be inserted through an underside of the bottom plate 104 and into the fastener holes 628 located on the bottom side 604 of the top body piece 304 as further discussed below.

Figure 7B:
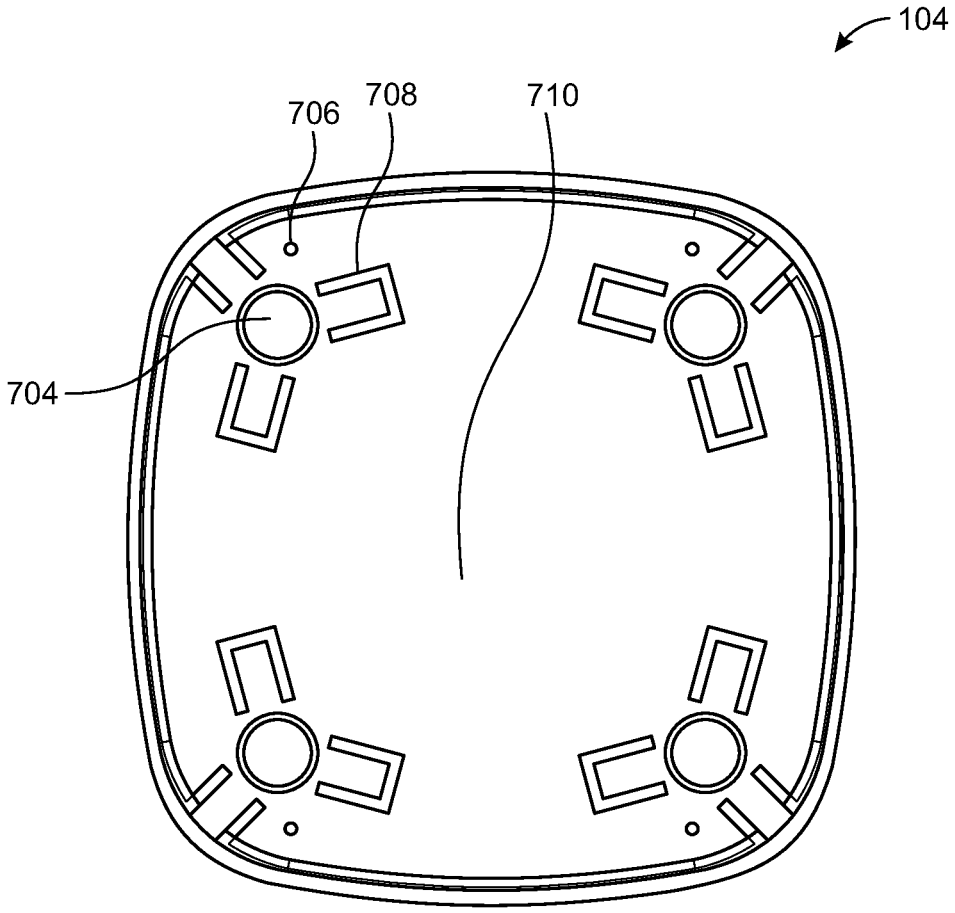
FIG. 7B is a top view of the bottom plate of the rolling drink coaster shown in FIG. 1
Figure 7C:
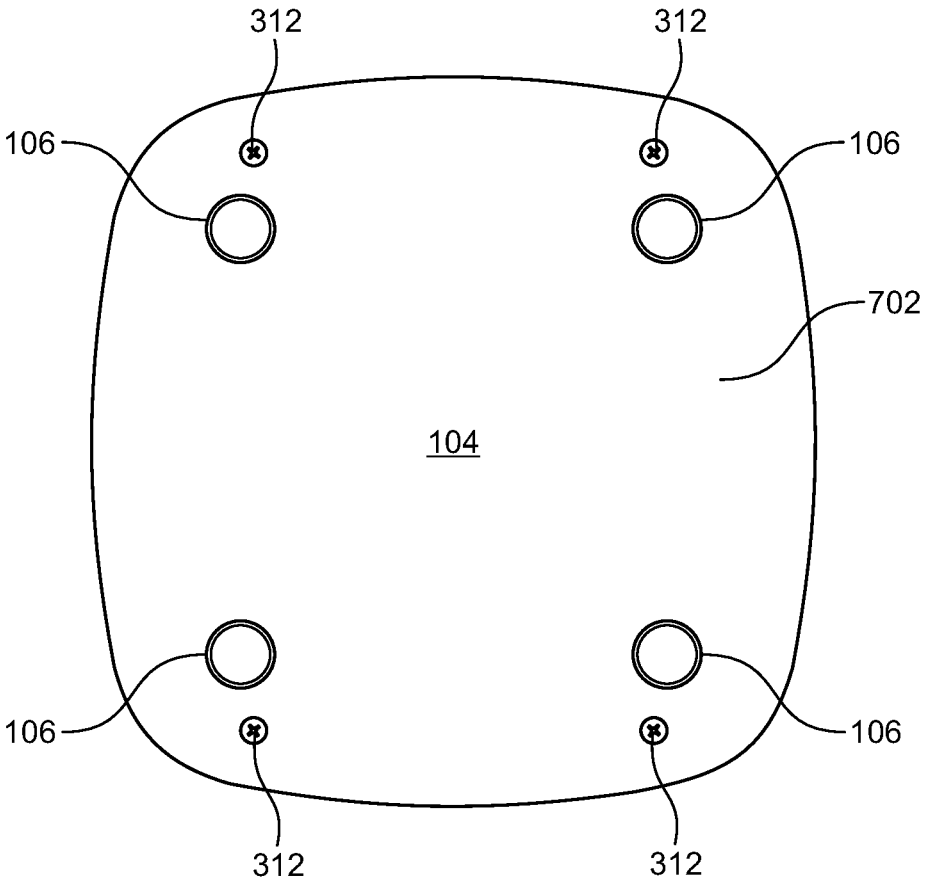
FIG. 7C is a bottom view of the bottom plate of the rolling drink coaster with rollers.

Turning to FIGS. 7A-7C, FIGS. 7A-7C show different views of the bottom plate 104. FIG. 7A is a bottom view of the bottom plate 104. FIG. 7B is a top view of the bottom plate 104. FIG. 7C is a bottom view of the bottom plate 104 with the one or more rollers 106 inserted in the designated roller holes 704 integrated into the bottom plate 104.

As shown in FIG. 7A, each corner of the bottom plate 104 includes a designated roller hole 704 designated for receiving a roller 106. The bottom side 702 of the bottom plate 104 further includes one or more fastener holes 706, which is where the fasteners 312 may be inserted to couple to the underside 604 of the top body piece 304 and to be inserted into the fastener holes 628 on the top body piece 304 as shown in FIG. 6D.

As shown in FIG. 7B, on the top side 710 of the bottom plate 104, there are designated axel assembly slots 708 for the axel assemblies 306 that mirror the axel assembly slots 622 and groupings 642-A, 642-B, 642-C, and 642-D shown in FIGS. 6A-6D. The top side 710 of the bottom plate 104 couples to the underside 604 of the top body piece 304, and as such, the top side 710 of the bottom plate 104 has the same configuration of axel assembly slots 708 as the axel assembly slots 622 of the top body piece 304 in order for the bottom plate 104 to fit snugly over each axel assembly 306 and for the rollers 106 to be able to fit through the roller holes 704 of the bottom plate 104.

FIG. 7C shows the bottom side 702 of the bottom plate 104 with the rollers 106 fitted and inserted into each designated roller hole 704 in the bottom plate 104. The fasteners 312 are also shown in FIG. 6C as being inserted and positioned in their corresponding fastener holes (e.g., fastener holes 706 as shown in FIG. 7A). Thus, the bottom plate 104 may be coupled to the top assembly 102, and more specifically, to the underside 604 of the top body piece 304 in one or more non-limiting embodiments. The rollers 106 that protrude from the bottom 112 (e.g., as shown in FIG. 2) of the rolling drink coaster 100 and from the bottom surface 702 of the bottom plate 104 allow the rolling drink coaster 100 to be mobile and to glide or roll along a table surface or other surface while holding the beverage container 101 in a stabilized and secure manner.

Figure 8A:
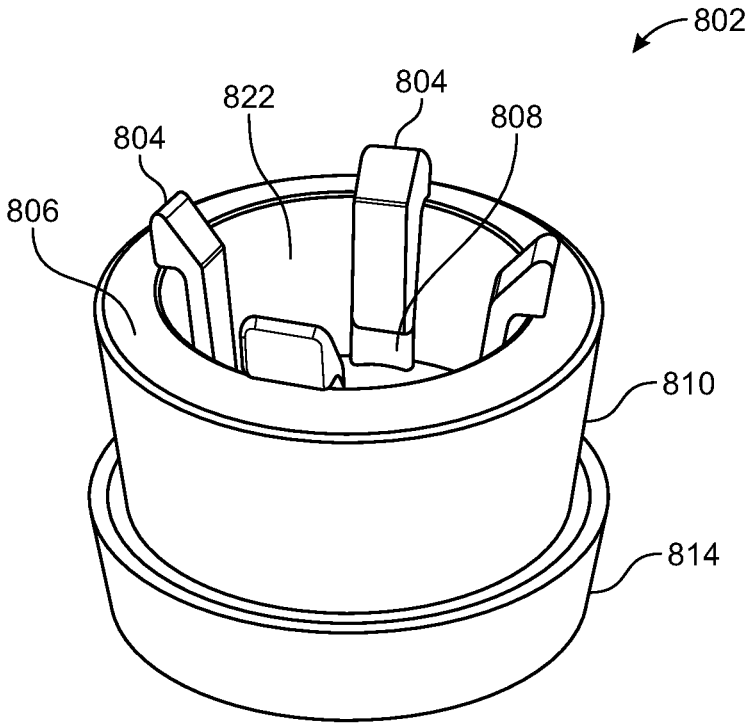
FIG. 8A is a side perspective view of another embodiment for a rolling drink coaster.
Figure 8B:
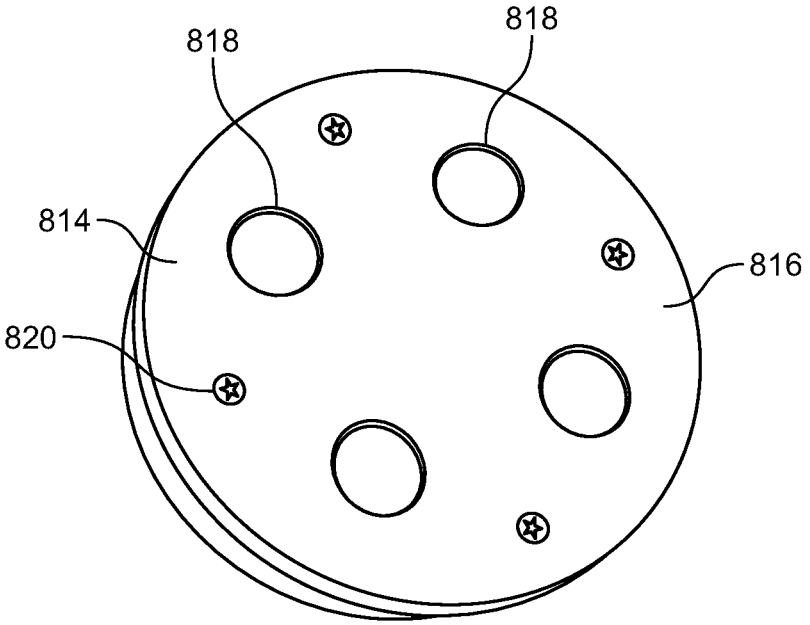
FIG. 8B is a bottom view of the rolling drink coaster shown in FIG. 8A.

FIGS. 8A-8B is another slightly different embodiment for a rolling drink coaster 802. As shown in FIG. 8A, rolling drink coaster 802 may include an outer wall 810 connected to a base 814. On the bottom surface 816 of the base 814, there may be one or more rollers 818 as shown in FIG. 8B. FIG. 8A shows that the rolling drink coaster 802 may include an interior piece 806 coupled to the inner sides of the outer wall 810. The outer wall 810 may be a continuous single piece in one or more non-limiting embodiments.

In one or more non-limiting embodiments, the interior piece 806 may be made of foam so as to help to cushion the beverage container (e.g., beverage container 101) located within the rolling drink coaster 802. Other compressible and elastic materials may also be used in addition or in alternative to foam.

There may be one or more stabilizers 804 distributed in a generally circular arrangement within the rolling drink coaster 802 and positioned against the inner sides of the interior piece 806. More specifically, there may be one stabilizer 804 located on each side of the interior of the outer wall 810 of the rolling drink coaster 802.

It is noted that each stabilizer 804 may be the same in form and function as the stabilizers 108 discussed above with respect to FIGS. 1-7C. Accordingly, the stabilizers 108 act to support, secure, and cushion the side surfaces of a beverage container 101. The base 814 may be wider than the outer wall 810, as shown in FIG. 8A. In one or more non-limiting embodiments, the base 814 may be fastened to the outer wall 810 from the bottom 816 of the base 814 using one or more fasteners 820 as shown in FIG. 8B. The rollers 818 shown in FIG. 8B may be distributed in a generally square arrangement with one roller 818 located on each corner of the base 814. In one or more non-limiting embodiments, the outer wall 810 and the base 814 of the rolling drink coaster 802 may be cylindrically shaped, although any other shape or form may be used in alternative configurations.

Notably, the present description includes various embodiments for a variety of rolling drink coasters, including rolling drink coaster 100 and rolling drink coaster 802. The components and design for rolling drink coaster 100 may be interchangeable with the components and design for rolling drink coaster 802 to form various other embodiments. Each rolling drink coaster 100 and 802 is able to provide a mobile drink coaster that appeals to users as a novel and entertaining tool. Further, the rolling drink coasters 100 and 802 described herein may stabilize one's beverage container when located in the drink coaster via the unique structure and design of each rolling drink coaster 100 and 802. One of ordinary skill in the art may understand that many more benefits and advantages may be provided by rolling drink coasters 100 and 802 as described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A rolling drink coaster, the rolling drink coaster comprising:

an outer body having one continuous outer wall and an interior cavity;

an insert piece, the insert piece coupled to an inner wall of the outer body and extends around an inner perimeter of the outer wall of the outer body;

at least four stabilizers attached to the inner wall of the insert piece, each stabilizer of the at least four stabilizers comprise a top portion joined with a back piece, wherein a top portion of each stabilizer of the at least four stabilizers protrudes over a top surface of the insert piece, and wherein the back piece of each stabilizer of the at least four stabilizers is a vertical piece that extends down each side of the inner wall of the insert piece on each side of the insert piece, and wherein the at least four stabilizers are positioned in a perpendicular arrangement with each other on each side of the insert piece;

a base, wherein the base is coupled to a bottom surface of the outer body; and one or more rollers, wherein the one or more rollers protrude from a bottom surface of the base, and wherein the rolling drink coaster is movable due to the one or more rollers.

2. The rolling drink coaster of claim 1, wherein the insert piece is made of foam.

3. The rolling drink coaster of claim 1, wherein the interior cavity of the rolling drink coaster is configured to hold a beverage container, and wherein the back piece of each stabilizer of the at least four stabilizers is configured to vertically extend down into each side of the insert piece and does not include a hook piece that protrudes upwardly into the interior cavity of the insert piece.

4. A rolling drink coaster, comprising:

a top assembly further comprising a top insert piece, the top insert piece further comprising:

an outer wall;

an inner wall, wherein one or more edges of the inner wall is recessed from one or more edges of the outer wall, and wherein the inner wall is beneath the outer wall;

one or more stabilizer slots disposed within the outer wall and the inner wall, wherein the one or more stabilizer slots are configured to hold one or more stabilizers of the rolling drink coaster; and a top body piece, wherein the top insert piece is configured to fit over the top body piece;

the one or more stabilizers distributed around an inner perimeter of the top assembly, wherein the one or more stabilizers protrude onto a top edge of the top assembly from the one or more stabilizer slots and are visible from a top surface of the top assembly and a back piece of the one or more stabilizers extends down each side of the top assembly without having a hook piece curving into an inner cavity of the top assembly; and one or more rollers a bottom plate, wherein the bottom plate is coupled to a bottom surface of the top assembly; and, wherein the one or more rollers extend through a body of the bottom plate, wherein the rolling drink coaster is mobile due to the one or more rollers.

5. The rolling drink coaster of claim 4, wherein each of the one or more stabilizers is configured to hook onto the top assembly, wherein the one or more stabilizers slots are generally positioned centrally on each side of the top insert piece, and wherein the one or more stabilizer slots comprises four stabilizer slots that are positioned in a perpendicular arrangement with each other on each side of the top insert piece.

6. The rolling drink coaster of claim 4, wherein a bottom surface of the top body piece comprises a grouping of one or more axel assembly slots, wherein each of the one or more axel assembly slots is configured to receive an axel assembly.

7. The rolling drink coaster of claim 6, wherein each axel assembly comprises a holding ring and a pin, wherein the pin is configured to be inserted within an interior bore of the holding ring.

8. The rolling drink coaster of claim 6, wherein one or more axel assembly slots comprises at least three axel assembly slots configured in a triangular arrangement.

9. The rolling drink coaster of claim 6, wherein a space or gap is included in a center area of the triangular arrangement, wherein the space or gap is configured to receive a roller of the one or more rollers.

10. The rolling drink coaster of claim 4, wherein the one or more rollers comprises at least four rollers.

11. The rolling drink coaster of claim 4, wherein the bottom plate is fastened to a bottom surface of the top assembly.

12. The rolling drink coaster of claim 4, wherein the top assembly further comprises an interior cavity that is configured to hold a beverage container.

13. The rolling drink coaster of claim 4, wherein the one or more stabilizers is configured to support and secure the beverage container within a interior cavity of the top assembly.

14. The rolling drink coaster of claim 4, wherein a top portion of the one or more stabilizers protrudes above a top surface of the top assembly.

15. The rolling drink coaster of claim 4, wherein the outer wall of the top insert piece is angled.

* * * * *